US005337528A

United States Patent [19]

Jaworski et al.

[11] Patent Number: 5,337,528

[45] Date of Patent: Aug. 16, 1994

[54] CHILD ASSIST RAIL AND SUPPORT SYSTEM

[76] Inventors: Frank Jaworski, 1426 Deerpath La., La Grange Park, Ill. 60525; Sabrina Jansen, 2908 Alma Ave., Manhattan Beach, Calif. 90266; Wayne Jaworski, 5606 Riverview Dr., Lisle, Ill. 60532

[21] Appl. No.: 984,912

[22] Filed: Dec. 2, 1992

[51] Int. Cl.[5] ..... E04F 11/00

[52] U.S. Cl. ..... 52/182; 256/21; 256/22; 256/59

[58] Field of Search ..... 52/182; 256/24, 21, 256/22, 59, 1

[56] References Cited

U.S. PATENT DOCUMENTS

| | | | |
|---|---|---|---|
| 2,909,361 | 10/1959 | Dotson | 256/22 |
| 3,005,242 | 10/1961 | Roberts | 256/21 |
| 4,352,485 | 10/1982 | Basey | 256/22 |
| 4,383,676 | 5/1983 | Souza, Jr. | 256/59 |
| 4,556,201 | 12/1985 | Turner | 256/59 |

*Primary Examiner*—Carl D. Friedman

*Assistant Examiner*—Christopher T. Kent

*Attorney, Agent, or Firm*—Lyon & Lyon

[57] ABSTRACT

A child assist rail and support system is disclosed which is adapted for attachment to an existing or new handrail at a stairway. The child assist rail and support system includes a plurality of suspension elements and a strap associated with each suspension element. The strap is adapted to suspend the associated suspension element below the handrail. The strap is further adapted to position a first end of its associated suspension element proximate to said handrail of the stairway. There is an auxiliary rail positioned at a second end of each of the suspension elements. The strap is also operative to maintain the auxiliary rail in a proximate position with respect to the second end of each of the suspension elements. There is a locking element operative with the strap of each of the suspension elements. The locking element is operative with the strap and the suspension element for maintaining the auxiliary rail in a substantially stationery position with respect to the handrail of the stairway.

10 Claims, 1 Drawing Sheet

CHILD ASSIST RAIL AND SUPPORT SYSTEM

BACKGROUND OF THE INVENTION

1. Field of the Invention

This invention relates to a child assist rail and support system for use with a new or existing handrail at a stairway.

2. Description of the Prior Art and Operative Environment of the Invention

It is well-known that child safety is of paramount importance in today's society. The health and well-being of a child is fundamental to the happiness of a family and continued development of the child. One of the most prominent ways children have been injured in the past is by traversing stairways. Normally, stairways are provided with a handrail which extends outwardly from the wall of the stairway and is maintained in a fixed relationship with respect to the wall by a plurality of brackets which are connected to the wall by conventional means and are also connected to the handrail.

The handrail may be made of a wide variety of materials. Traditionally, handrails are wood and are attached to a series of metal brackets, which are then attached to the wall. In other manners of construction, the handrail may be metal and is either positioned above the stairway by a plurality of posts which are attached to the underside of the handrail or the metal handrail is attached to a plurality of metal brackets which are then attached to the stairway wall. It is also known that the support posts for the handrail may be made out of wood or the entire assembly of rail and support posts made out of wood.

In any event, the traditional stairway handrail provides a downwardly extending line for use by the person traversing the stairway as a means of support. The exact angle of the handrail may vary depending upon architectural preference and functional considerations.

It is observed that normally, according to building codes, the handrail is at a required height. In many States that required height is 36 inches. Thus, the handrail is constructed and positioned to accommodate adult individuals of height in excess of 5 feet. When constructed in this manner, the individual using the handrail is able to grasp the handrail, while walking up or down the stairs, and by maintaining their arms in a downwardly extending position is able to traverse the stairs in a relatively safe manner. The head of the adult is tilted downwardly when traversing the stairway to accommodate simultaneous viewing of the handrail and the stairs. In this manner, safe traversal of the stairway is achieved.

However, it is well-known that children after the age of one year are often able to traverse stairways and will attempt to do so without adult supervision or assistance. Normally, children by the age of two are easily able to move up and down stairways either by crawling or by walking. In cases where the child is very young, such as one to three years old, the child's height, normally less than 36 inches or thereabouts, places the child in a somewhat difficult position, because that child when traversing the stairway, in either an up or a down pattern, is required to elevate his or her arm so as to grasp the handrail.

Often, a child is desirous of watching the individual steps as they are traversed and watching the handrail to assure himself or herself that a secure grasp on the handrail is being maintained. In an effort to maintain a secure grip on the handrail, the child will often rotate his or her body to grasp the handrail with both arms. Obviously, body rotation of a child on a stairway is an undesirable condition and should be avoided.

This often leads to considerable problems. In many instances, the child will affix its eyesight on the handrail in an effort to maintain a secure grasp of the handrail. When doing so, the child places himself or herself at some danger in that he or she is unable to watch his or her feet as they traverse the stairs. In other instances, the child watches the stairs and the position of his or her feet on the stairs but does not maintain sufficient eye contact with the handrail of the stairs to maintain safe traversal of the stairs. In either instance, the incidence of a child falling by reason of either missing a step or losing grasp of the handrail is increased with the attendant possibility of physical harm to the child.

Often, parents simply place a gate at both ends of a stairway in an effort to deter the child from traversing the stairway without adult assistance. This creates some difficulty in that an adult who wishes to traverse the stairway must then in each instance open the gate both at the bottom of the stair and the top of the stair for effective traversal of the stair. When the adult is carrying materials or packages, this often presents a difficult and somewhat dangerous environment.

Alternatively, the child may be taught to grasp the support posts of the handrail in order to maintain the child's arm in a downwardly suspended position with respect to his or her shoulder. In this manner, the child is able to more readily observe both the handrail and the stairs that are being traversing. Unfortunately, a child when taught to grasp the downwardly extending posts often finds his or her arm positioned between the post, and if the child then slips and falls, severe injury could result.

3. Objects of the Present Invention

Therefore, it is a primary object of the present invention to provide a safe child assist rail and support system for use by children when traversing stairways.

It is a further object of the present invention to provide a versatile child assist rail and support system which is capable of being used with a wide variety of handrail designs.

It is a further object of the present invention to provide an easy to assemble and safe child assist rail and support system for use by a child, which can be assembled by an adult with limited mechanical difficulty and is adapted to be used with a wide variety of stairway and handrail designs.

SUMMARY OF INVENTION

In an effort to respond to the existing problems with present stairway and handrail designs, which are not adapted to be safely traversed by children, a child assist rail and support system is proposed which is adapted for attachment to an existing handrail or may be installed during handrail construction. The child assist rail and support system is an assembly which includes a plurality of suspension elements. These suspension elements are disposed at a preselected distances from each other to provide a support system for an auxiliary rail. With each suspension element there is a strap adapted to suspend the associated suspension element below the handrail of the stairway. The strap is further adapted to position a first end of each of the suspension elements proximate to the handrail.

In the preferred embodiment, an auxiliary rail is provided and is positioned at a second end of each suspension element. The strap is operative to maintain the auxiliary rail in a proximate position to the second end of each of the suspension elements. Each strap is securely attached to one suspension element, normally in the area proximate the buckle.

There are a plurality of straps provided, one strap for each of the suspension elements. With each strap there is a locking element which is operative with the strap and associated suspension element for maintaining the auxiliary rail in a substantially stationery position with respect to the handrail. When assembled, the auxiliary rail is positioned below the existing handrail and provides a lower rail for the child to grasp while traversing the stairs. By maintaining a consistent length of suspension element, the angle at the existing handrail is translated to the auxiliary rail.

The locking element is preferably constructed as an over-center buckle which is used with a rigid suspension element and a variable length strap such that the strap is placed over the existing handrail and around the suspension element and then into the buckle. At one end of the suspension element, there is a cinching element which is operative to place tension on the suspension strap after it has been positioned through the buckle and the buckle operated to secure the strap. At the other end of the suspension element, there is a channel into which an auxiliary rail is received for the purposes stated herein above.

The strap is positioned around the auxiliary rail and into the buckle such that when the buckle is operated to tighten the strap around the handrail and auxiliary rail, the cinching element is then used to place a greater degree of tension on the strap. There is a secondary locking element provided with each strap and buckle to provide additional locking capability between the buckle and the strap.

BRIEF DESCRIPTION OF THE PREFERRED EMBODIMENT

Figure 1:
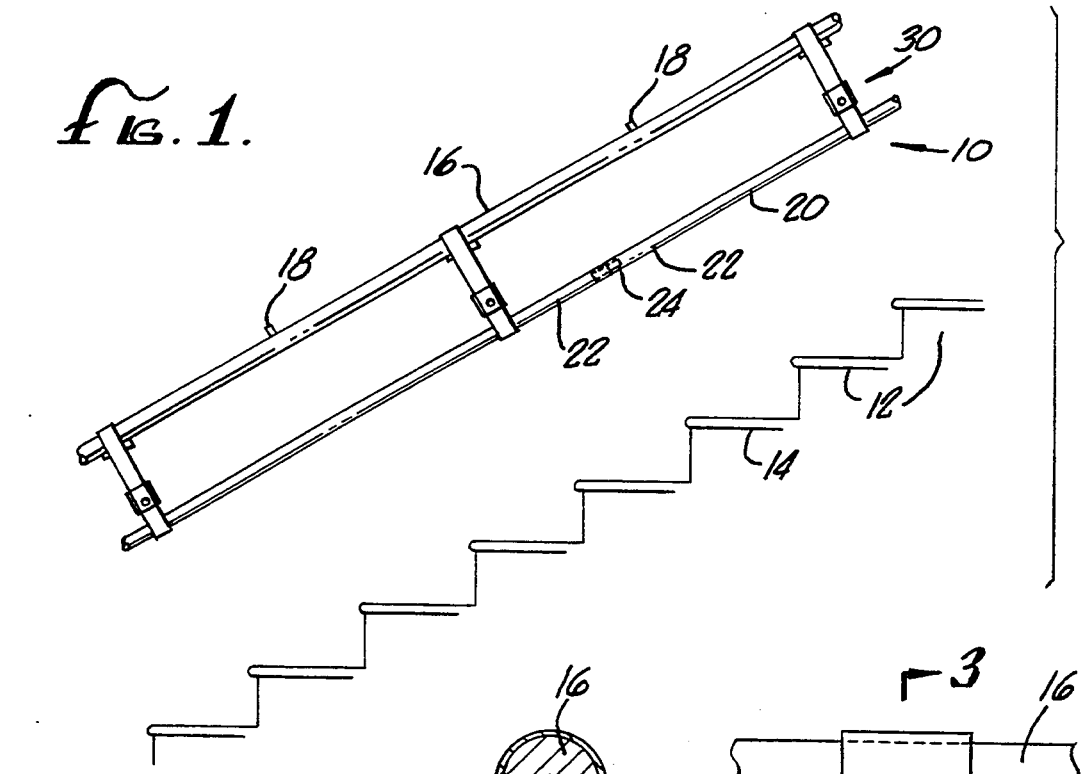
FIG. 1 is a prospective view of a stairway and an existing handrail with the child assist rail and support system of the present invention assembled for use.

A child assist rail and support system constructed in accordance with the present invention is illustrated in FIG. 1. The child assist rail and support system is generally designated with the numeral 10.

As shown in FIG. 1, an existing stairway in side elevation is designated with the numeral 12. The stairway 12 has a plurality of steps 14 which are normally six or seven inches in vertical distance from one another. Each step provides a platform for traversal up or down the stairway. Positioned above the steps 14 is a handrail 16 which is generally configured in a downwardly descending profile such that a continuous and preselected distance is maintained between the handrail 16 and the each of the steps 14. In this manner, the handrail 16 provides a place for grabbing and support while an individual traverses the steps 14.

The handrail 16 is normally attached to a stairway wall (not shown) by a plurality of brackets 18. The brackets 18 are normally constructed of metal and are configured in an L-shaped profile wherein one leg of the L is affixed to the wall and the other leg of the L is adapted to provide a seat and attachment location for the handrail 16. Various commonly employed constructions are provided for the brackets 18 with the purpose being that there is a rigid support assembly formed between the handrail 16, brackets 18, and the wall of the stairway 12.

The child assist rail and support system constructed in accordance with the present invention includes an auxiliary rail 20 which is designed to be maintained in a substantially parallel relationship with the handrail 16. The auxiliary rail 20 is preferable made of a material such as plastic which is hollow for weight considerations. However, it should be appreciated the other materials could be used for the auxiliary rail, such as wood.

Plastic has been found to be the most advantageous material because it is inexpensive and provides a smooth surface for the child to grasp. The use of wood may provide additional surfaces where a child could be injured by splinters unless the wood is evenly finished. The auxiliary rail 20 normally is assembled into a usable length by joining together a plurality of auxiliary rail segments 22 which are coupled together by a threaded element 24. In the preferred embodiment, the threaded element 24 is receivable into the interior portion of each auxiliary rail segment 22 and by rotating the auxiliary rail segments 22 in counter-directions along the threads, a rigid and smooth coupling is achieved. It should be appreciated that a wide variety of lengths of auxiliary rail segments 22 may be provided depending upon the versatility of the design sought to be achieved. The overall length of the auxiliary rail 20 is achieved by assembling numerous auxiliary rail segments 22 with a number of threaded elements 24.

It should be appreciated that in the event a curved stairway is provided, another auxiliary handrail design may be required which accommodates the curve. In those instances, a material other than plastic might be required which would provide the ability for bending the material to accommodate the curved portion of the stairway. Even in these instances, the auxiliary rail 20 should always be made of a substantially rigid material to provide maximum safety.

A plurality of suspension systems 30 are positioned between the handrail 16 and the auxiliary rail 20. The suspension systems 30 are operative to maintain a fixed and parallel relationship between the auxiliary rail 20 and the handrail 16. It should be appreciated that a wide variety of designs for the support systems 30 may be used with the child assist rail and supporting system 10 of the present invention. The purpose of these suspension systems 30 is to provide a rigid and structurally sound attachment for the auxiliary rail 20 to the handrail 16.

Figure 2:
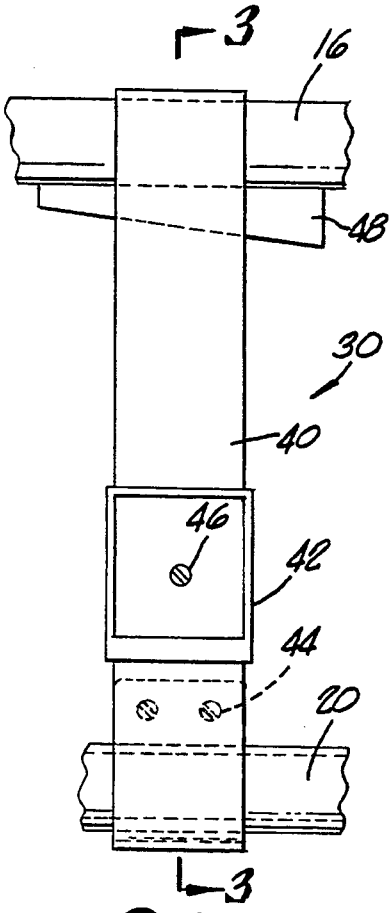
FIG. 2 is a front view of the strap of an assembled child assist rail and support system as it is positioned around the existing handrail and around the auxiliary rail with a front view of the buckle of the present invention.

A suspension system 30 made in accordance with the present invention is shown in prospective view in FIG. 2. In FIG. 2 an existing handrail 16 and auxiliary rail 20 are shown in side elevation. A strap 40 is provided which is constructed of a resilient yet flexible material capable of being bent but not torn. In the preferred embodiment, the strap 40 is made of a fiberglass reinforced material to provide great strength with a comparably low weight. The auxiliary rail 20 shown in FIG. 2 is hollow in the preferred embodiment for weight and coupling capabilities. Provided with the strap 40 is a buckle 42, which in the preferred embodiment is constructed with an over-center design. The over-center buckle 42 is adapted to receive one end of the strap 40. The over-center buckle 42 is maintained in a fixed relationship with regard to one end of the suspension element 50 by a plurality of screws or rivets 44 which attach the strap 40 to the suspension element 50.

A second locking element 46 is provided which is operative with the buckle 42 so that when the strap 40 is positioned through the buckle 42, the locking element 46 may be used to maintain a second lock. In this manner the strap 40 does not move with respect to the buckle 42 unless the locking element 46 is removed. In the preferred embodiment, the locking element 46 is a screw which is received into a hole bored through the strap 40.

To assist in assembly a cinching element 48 is used which is receivable into an upper portion of the suspension element 50. The location of the cinching element 48 in relation to the suspension element 50 is better shown in FIG. 3. The cinching element 48 is provided with a variable dimension to provide for increased tension on the strap 40 after the strap 40 has been received into the buckle 42 and maintained in a fixed relationship with respect to the buckle 42. Thus, the cinching element 50 accommodates the ability to vary the tension of the strap 40 for assembly purposes.

Figure 3:
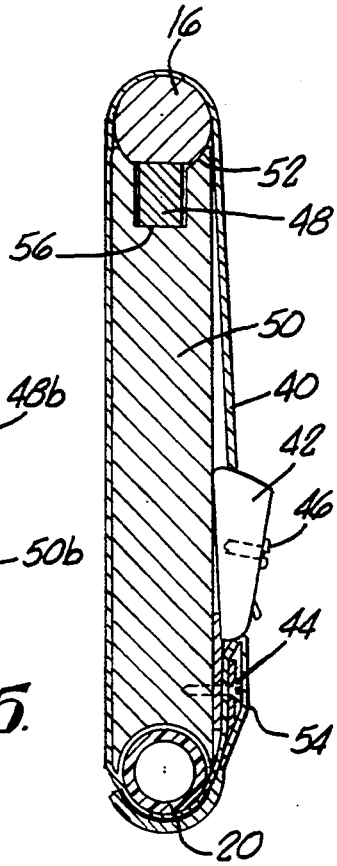
FIG. 3 is a cross-sectional view of the child assist rail and support system of FIG. 2 through the lines 3—3.

A cross-sectional view of the child assist rail and support system 10 of the present invention is shown in FIG. 3. The handrail 16 which is attached to the stairway wall is shown at the top of FIG. 3. The auxiliary rail 20 is shown at a predetermined distance from the handrail 16. A suspension element 50 is positioned between the handrail 16 and the auxiliary rail 20. The suspension element 50 has a profile at a first end 52 which is adapted to position the suspension element 50 proximate the handrail 16. At a second end of the suspension element 54, the suspension element 50 is profiled in a substantially semi-circular profile for receipt of the auxiliary rail 20. Thus, the suspension element 50 provides the ability to maintain the auxiliary rail 20 in a preselected and substantially rigid relationship with respect to the handrail 16.

The cinching element 48 is also shown in the cross-section in FIG. 3. The cinching element 48 is receivable into a channel 56 cut into the suspension element 50. The channel 56 provides the ability to move the cinching element 48 along an axis substantially parallel to the handrail 16 for the purpose of provided additional tension on the strap 40 once assembled. Also shown in FIG. 3 is a side profile of the buckle 42 which has received the strap 40. The locking element 46 is also shown in FIG. 3 and usable with the buckle 42 to provide a second element of safety in the use of the buckle 42. A plurality of screws 44 are visible to affix one end of the strap 40 to the suspension element 50.

Figures 4, 5:
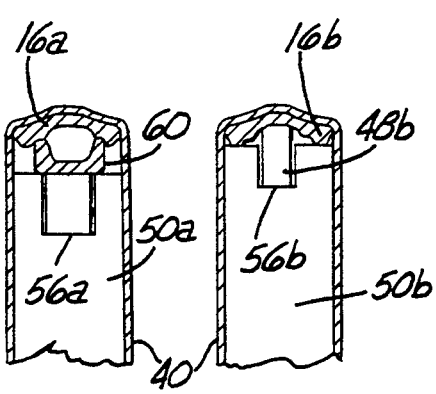
FIG. 4 is a frontal cross-sectional view of one form of handrail commonly found in stairways.
FIG. 5 is a front view of another form of handrail commonly found in stairways.

In FIG. 4, a cross-sectional view of another common handrail **16*a* is illustrated. The handrail 16*a* has an element 60 at its lower end which is placed in a close relationship to the suspension element 50*a*. A cinching element 48 (not shown) in FIG. 4 is receivable into the channel 56*a* of the suspension element 50*a* for the purposes designated heretofore. The strap 40 is also shown in FIG. 4**.

Another common form of handrail **16*b* is shown in FIG. 5. The suspension element 50*b* is positioned below the handrail 16*b* and is maintained in a close relationship by the strap 40. The channel 56*b* is adapted to receive a cinching element 48*b*, which when the strap 40 is assembled as heretofore described, the cinching element 48*b* is operative to place additional tension on the strap 40 for the purpose of maintaining the auxiliary rail (not shown) in FIG. 5 at in a preselected and substantially rigid relationship with respect to the handrail 16*b***.

The assembly of the present invention will now be described. The child assist rail and support system 10 comes with a plurality of lengths of auxiliary rail segments 22. The segments 22 are placed along the existing handrail and coupled together by the threaded elements 24. In this manner, the appropriate length of auxiliary rail is achieved for use with the existing handrail 16. After the auxiliary rail 20 has been assembled into the proper length, the suspension systems 30 are positioned at various locations along the handrail 16.

Each suspension system 30 has a strap 40 attached to an associated suspension element 50. The suspension element 50 is placed beneath the handrail 16 and the auxiliary rail 20 is positioned proximate the second end of the suspension element 50 distal from the handrail 16. The strap 40 is then fitted around the auxiliary rail 20 and over the handrail 16. After the strap 40 has passed around the handrail 16, it is pulled through the buckle 42. The buckle 42 is then latched in an over-center position which maintains a certain degree of tension upon the strap 40. Each of the suspension systems 30 is assembled along the length of the handrail 16.

After each of the suspension systems 30 has been assembled and the strap 40 associated with each suspension element 50 moved into a taut position with respect to the suspension element 50, the locking element 46 is used with the buckle 42 to rigidly affix the strap 40 to the buckle 42. When each suspension system 30 has been assembled in this manner, the cinching element 48 associated with each suspension element 50 is positioned between the lower surface of the handrail 16 and within the channel 56 of the suspension element 50. By then striking the cinching element 48 with a hammer or other implement, the variable profile of the cinching element 48 causes a increased tension to be created upon the strap 40. This increased tension is operative to maintain the auxiliary rail 20 in a substantially rigid relationship with respect to the handrail 16. In this manner, the auxiliary rail 20 is positioned at a predetermined distance from the existing handrail 16.

Thus, when a child desires to traverse a stairway in either an upward or downward direction, the child is able to grasp the auxiliary rail 20 as opposed to the handrail 16. The auxiliary rail 20 is suspended at a predetermined distance, often 12 inches below the existing handrail 16. In this manner, a child of three feet, or even less, in height can grasp the auxiliary rail 20 with his or her arm in a substantially more parallel relationship with respect to his or her shoulder. Thus, the child is able to more expeditiously grasp the auxiliary rail 20 and traverse the stairway 12 without grasping the a handrail 16 at an abnormally high position with regard to a child's height. In this manner, child safety is improved while the child is traversing a stairway.

It should be appreciated that although the present invention has been described in great detail herein, there are other techniques that can be used to suspend an auxiliary rail 20 below an existing handrail 16. A preferred embodiment of a suspension system 30 has been shown in the present invention. However, it is the intent of the present invention to accommodate a suspension system which provides for a substantially rigid relationship to exist between an existing handrail 16 and an auxiliary rail 20 positioned below the handrail 16.

It should also be appreciate that various materials may be used other than those described in the present invention. For example, the cinching element 48 may be made of plastic, wood or metal. In addition, the suspension elements 50 may be comprise of plastic, wood, or metal. The strap 40 may be either reinforced cloth or other suitable materials. The preferred embodiment of the buckle 42 found to date is constructed in an over-center manner to provide for easier assembly and use. It should also be appreciated that other locking elements 46 may be used with the buckle 42 to provide a secure relationship between the buckle 42 and the strap 40.

While the present invention has been described in great detail, it should be appreciated that the description contained herein is not intended to limit the scope of the appended claims but rather to describe the only presently preferred embodiment.

What is claimed:

1. A child assist rail and support system adapted for use with an existing handrail at a stairway, the handrail positioned a set distance from a wall within the stairway, the child assist rail and support system comprising:

a plurality of rigid suspension elements, flexible strap means adapted to suspend said rigid suspension elements below the handrail, said flexible strap means further adapted to position a first end of said rigid suspension elements proximate to a lower surface of the handrail, said flexible strap means adapted to be disposed along a surface of the handrail, an auxiliary rail positioned at a second end of said rigid suspension elements, said flexible strap means operative to maintain said auxiliary rail in a position proximate to said second end of said rigid suspension elements, said flexible strap means disposed along a surface of said auxiliary rail, locking means operative with said flexible strap means and said rigid suspension elements to maintain said auxiliary rail in a substantially stationery position with respect to the handrail.

2. The child assist rail and support system of claim 1, further comprising:

cinch means adapted for use with said suspension elements for varying the tension on said flexible strap means, said cinch means adapted to be positioned between a lower surface of the handrail and an upper surface of said suspension elements.

3. The child assist rail and support system of claim 1, wherein said locking means comprises a buckle receiving said strap means.

4. The child assist rail and support system of claim 3, wherein said buckle is an over-center buckle.

5. The child assist rail and support system of claim 4, which includes a set screw operates with said buckle to maintain said strap means in a fixed relationship with respect to said buckle.

6. The child assist rail and support, system of claim 2, wherein said cinch means is received into a channel found in a first end of each of said suspension elements, said cinch means adapted to selectably adjust the tension in said strap means when assembled with said handrail, auxiliary rail, and suspension elements.

7. A child assist rail and support system operative with a handrail at a stairway, the handrail positioned a predetermined distance from a wall of the stairway, said child assist rail and support system comprising:

an auxiliary rail, means for positioning said auxiliary rail a predetermined distance below the handrail, means for maintaining said auxiliary rail at said predetermined distance below said handrail, said maintaining means comprising:

at least one flexible strap, at least one suspension element, said suspension element having means for receiving the auxiliary rail, said suspension element adapted to be positioned below the handrail, said flexible strap adapted to extend at least partially around portion of the handrail and at least partially around said auxiliary rail, wherein said auxiliary rail is operative to provide support for an individual while traversing the stairway.

8. The child assist rail and support system of claim 7, wherein said auxiliary rail is adapted to be of a varying length.

9. A child assist rail and support system of claim 7, wherein said positioning means further comprises:

a plurality of suspension elements, said flexible strap means operates with each of said suspension elements for maintaining said auxiliary rail a predetermined distance from the handrail, buckle means operates with each of said flexible strap means for affixing said auxiliary rail in a substantially rigid relationship with respect to the handrail.

10. A child assist rail and support system adapted for use with an existing handrail at a stairway, the handrail positioned a set distance from a wall within the stairway, the child assist rail and support system comprising:

a plurality of suspension elements, strap means adapted to suspend the suspension elements below the handrail, said strap means further adapted to position a first end of said suspension elements proximate to the handrail, an auxiliary rail positioned at a second end of said suspension elements, said strap means operates to maintain said auxiliary rail in a proximate position to said second end of said suspension elements, locking means operates with said strap means and said suspension elements to maintain said auxiliary rail in a substantially stationery position with respect to the handrail, said locking means including a buckle adapted to receive said strap means, said buckle being an over-center buckle, a set screw operates with said buckle to maintain said strap means in a fixed relationship with respect to said buckle, and cinch means received into a channel found in a first end of each of said suspension elements, said cinch means adapted to selectably adjust the tension in said strap means.

* * * * *